US010149352B2

(12) United States Patent
Huang et al.

(10) Patent No.: US 10,149,352 B2
(45) Date of Patent: Dec. 4, 2018

(54) MICROWAVE OVEN

(71) Applicants: Guangdong Midea Kitchen Appliances Manufacturing Co., Ltd., Foshan (CN); Midea Group Co,. Ltd., Foshan (CN)

(72) Inventors: Zhifei Huang, Foshan (CN); Quanhong Jiang, Foshan (CN); Shiyong Liu, Foshan (CN); Motan Zhu, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 975 days.

(21) Appl. No.: 14/548,661

(22) Filed: Nov. 20, 2014

(65) Prior Publication Data

US 2015/0305095 A1 Oct. 22, 2015

(30) Foreign Application Priority Data

Apr. 21, 2014 (CN) ..... 2014 1 0160924
Apr. 21, 2014 (CN) ..... 2014 2 0195024 U

(51) Int. Cl.
*H05B 6/64* (2006.01)

(52) U.S. Cl.
CPC ..... *H05B 6/6423* (2013.01)

(58) Field of Classification Search
CPC ..... H05B 6/6423
USPC ..... 219/757
See application file for complete search history.

(56) References Cited

U.S. PATENT DOCUMENTS 4,327,274 A * 4/1982 White ..... F24C 15/2042 126/198
4,431,888 A * 2/1984 Simpson ..... H05B 6/725 219/746
6,509,556 B2 * 1/2003 Kim ..... H05B 6/642 126/21 A (Continued)

FOREIGN PATENT DOCUMENTS

CN 101672489 A 3/2010

OTHER PUBLICATIONS

Chinese Patent Application No. 201410160924.8, First Office Action dated Aug. 2, 2016, with English translation, 10 pages.

*Primary Examiner* — Ibrahime A Abraham
*Assistant Examiner* — Spencer h Kirkwood
(74) *Attorney, Agent, or Firm* — Lathrop Gage LLP

(57) ABSTRACT

A microwave oven includes an outer housing defining an accommodating chamber therein and having a first cooling air inlet and a first cooling air outlet therein; an inner housing disposed within the accommodating chamber and defining a heating chamber therein, the heating chamber having a second cooling air inlet and a second cooling air outlet communicated with the first cooling air outlet, a cooling air passage being defined between an upper surface of the inner housing and a top wall of the accommodating chamber and communicated with the second cooling air inlet; a cooling fan having an air inlet communicated with the first cooling air inlet via an air inlet passage and an air outlet communicated with the cooling air passage; and an electrical component disposed within the cooling air passage.

14 Claims, 8 Drawing Sheets

(56) References Cited

U.S. PATENT DOCUMENTS

| | | | | |
|---|---|---|---|---|
| 6,768,090 | B2 * | 7/2004 | Kang | H05B 6/6429<br>219/391 |
| 7,180,041 | B2 * | 2/2007 | Song | F24C 15/2042<br>126/21 A |
| 7,482,562 | B2 * | 1/2009 | Song | F24C 15/20<br>126/21 A |
| 2013/0087133 | A1 * | 4/2013 | Davis | F24C 15/20<br>126/299 D |

* cited by examiner

MICROWAVE OVEN

CROSS REFERENCE TO RELATED APPLICATION

This application claims priority and benefits of Chinese Patent Applications No. 201410160924.8 and No. 201420195024.2, filed with State Intellectual Property Office on Apr. 21, 2014, the entire content of which is incorporated herein by reference.

FIELD

Embodiments of the present invention generally relate to a household appliance, and more particularly, to a microwave oven.

BACKGROUND

Generally, microwave ovens in the related art have a problem of poor cooling efficiency, which may affect a heating performance of the microwave oven and reduce a service life of the microwave oven.

SUMMARY

Embodiments of the present invention seek to solve at least one of the problems existing in the related art to at least some extent.

Embodiments of the present invention, a microwave oven is provided. The microwave oven includes an outer housing defining an accommodating chamber therein and having a first cooling air inlet and a first cooling air outlet therein; an inner housing disposed within the accommodating chamber and defining a heating chamber therein, the heating chamber having a second cooling air inlet and a second cooling air outlet communicated with the first cooling air outlet, a cooling air passage being defined between an upper surface of the inner housing and a top wall of the accommodating chamber and communicated with the second cooling air inlet; a cooling fan having an air inlet communicated with the first cooling air inlet via an air inlet passage and an air outlet communicated with the cooling air passage; and an electrical component disposed within the cooling air passage.

Thus, the microwave oven according to embodiments of the present invention can have excellent cooling efficiency and heating performance.

In some embodiments, the cooling fan is disposed within the air inlet passage.

In some embodiments, the cooling fan is positioned between the upper surface of the inner housing and the top wall of the accommodating chamber.

In some embodiments, the microwave oven further includes a side plate disposed on the upper surface of the inner housing and defining an accommodating space with a front wall of the accommodating chamber, the first cooling air inlet and outlet being formed in the front wall of the accommodating chamber; a first plate disposed within the accommodating space and defining an air outlet passage with the side plate and the front wall of the accommodating chamber, the first cooling air outlet and the second cooling air outlet being communicated with each other via the air outlet passage; and a second plate disposed within the accommodating apace, the second plate defining one of the cooling air passage and the air inlet passage with the first plate and the front wall of the accommodating chamber, and the second plate defining the other of the cooling air passage and the air inlet passage with the side plate and the front wall of the accommodating chamber.

In some embodiments, the microwave oven further includes a left fan and a right fan, wherein the outer housing defines a smoke inlet in a bottom thereof and a smoke outlet therein, wherein a left air passage is formed between a left wall of the accommodating chamber and a left surface of the inner housing and communicated with smoke inlet and the smoke outlet of the outer housing, the left fan is disposed within the left air passage, wherein a right air passage is formed between a right wall of the accommodating chamber and a right surface of the inner housing and communicated with smoke inlet and the smoke outlet of the outer housing, the right fan is disposed within the right air passage.

In some embodiments, the smoke inlet comprises a left smoke inlet opposed to the left air passage in an up-down direction and a right smoke outlet opposed to the right air passage in the up-down direction.

In some embodiments, each of the left fan and the right fan is configured as a double suction fan and oriented horizontally.

In some embodiments, each of the left fan and the right fan is extended in a front-rear direction.

In some embodiments, the microwave oven further includes a left air guard disposed within the left air passage and located above the left fan, the left air guard defining a first vent corresponding to an air outlet of the left fan; and a right air guard disposed within the right air passage and located above the right fan, the right air guard defining a second vent corresponding to an air outlet of the right fan.

In some embodiments, the microwave oven further includes a left support plate disposed within the left air passage and defining a third vent corresponding to an air inlet of the left fan, the left fan being mounted on the left support plate; and a right support plate disposed within the right air passage and defining a fourth vent corresponding to an air inlet of the right fan, the right fan being mounted on the right support plate.

In some embodiments, the outer housing includes a bottom plate defining the smoke inlet therein; a top plate; a front plate connected with the bottom and top plates and defining the first cooling air inlet and outlet therein; a rear plate connected with the bottom and top plates; a left plate connected with the bottom and top plates; and a right plate connected with the bottom and top plates, wherein at least one of the top plate, the front plate and the rear plate defines the smoke outlet therein.

In some embodiments, each of the left and right fans is adjacent to the bottom plate.

In some embodiments, the microwave oven further includes a first filter and a second filter, wherein the front plate defines the smoke outlet therein, the first filter is disposed on the bottom plate and covers the smoke inlet, and the second filter is disposed on the front plate and covers the smoke outlet.

In some embodiments, the microwave oven further includes a separating plate disposed within the accommodating chamber to divide the accommodating chamber into left and right smoke exhaust passages separated from each other, wherein a bottom wall of the accommodating chamber defines a left smoke inlet and a right smoke inlet spaced in a left-right direction, at least one of a front wall, the top wall and a rear wall of the accommodating chamber defines a left smoke outlet and a right smoke outlet spaced in the left-right direction, wherein the left smoke inlet and outlet are communicated with the left smoke exhaust passage, and the right smoke inlet and outlet are communicated with the right smoke exhaust passage.

In some embodiments, the front wall of the accommodating chamber defines a first left smoke outlet and a first right smoke outlet, the rear wall of the accommodating chamber defines a second left smoke outlet and a second right smoke outlet, and the top wall of the accommodating chamber defines a third left smoke outlet and a third right smoke outlet, wherein the first, second and third left smoke outlets are communicated with the left smoke exhaust passage, and the first, second and third right smoke outlets are communicated with the right smoke exhaust passage.

In some embodiments, the separating plate is disposed on the upper surface of the inner housing, a front edge of the separating plate is contacted with the side plate, a rear edge of the separating plate is contacted with the rear wall of the accommodating chamber, and an upper edge of the separating plate is contacted with the top wall of the accommodating chamber.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the accompanying drawings, in which.

DETAILED DESCRIPTION

Figure 1:
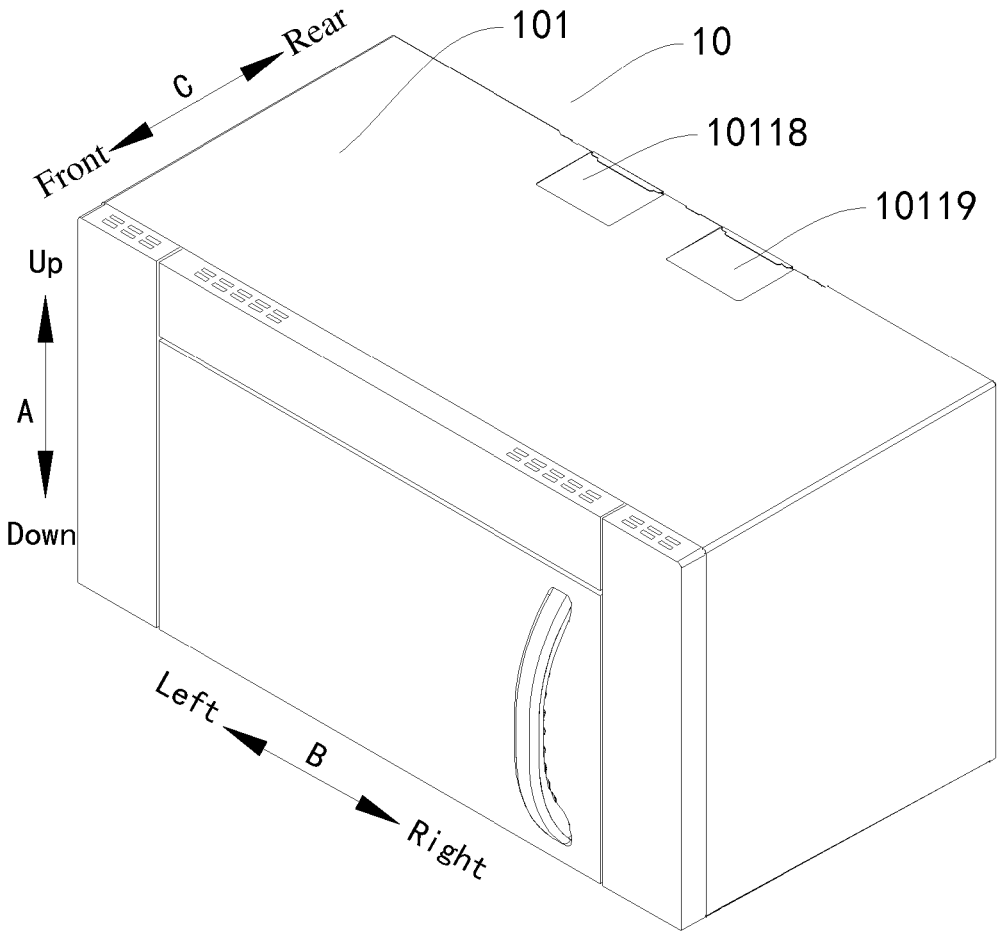
FIG. 1 is a perspective view of a microwave oven according to an embodiment of the present invention.

Reference will be made in detail to embodiments of the present invention. The embodiments described herein with reference to drawings are explanatory, illustrative, and used to generally understand the present invention. The embodiments shall not be construed to limit the present invention. The same or similar elements and the elements having same or similar functions are denoted by like reference numerals throughout the descriptions.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present invention be constructed or operated in a particular orientation.

Terms concerning attachments, coupling and the like, such as "connected" and "interconnected", refer to a relationship in which structures are secured or attached to one another either directly or indirectly through intervening structures, as well as both movable or rigid attachments or relationships, unless expressly described otherwise.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also, it is to be understood that phraseology and terminology used herein with reference to device or element orientation (such as, for example, terms like "central," "upper," "lower," "front," "rear," and the like) are only used to simplify description of the present invention, and do not alone indicate or imply that the device or element referred to must have a particular orientation.

In addition, terms such as "first" and "second" are used herein for purposes of description and are not intended to indicate or imply relative importance or significance.

A microwave oven according to embodiments of the present invention will be described referring to FIG. 1-FIG. 8.

As shown in FIG. 1-FIG. 8, the microwave oven 10 according to embodiments of the present invention includes an outer housing 101, an inner housing 102, a cooling fan 103 and an electrical component 104.

The outer housing 101 defines an accommodating chamber 1011 therein and has a first cooling air inlet 10121 and a first cooling air outlet 10122 therein. The inner housing 102 is disposed within the accommodating chamber 1011 and defines a heating chamber 1021 therein, the heating chamber 1021 has a second cooling air inlet 10211 and a second cooling air outlet 10212 which is communicated with the first cooling air outlet 10122. A cooling air passage 1022 is defined between an upper surface 1025 of the inner housing 102 and a top wall of the accommodating chamber 1011 and communicated with the second cooling air inlet 10211. The cooling fan 103 has an air inlet communicated with the first cooling air inlet 10121 via an air inlet passage 1023 and an air outlet communicated with the cooling air passage 1022. The electrical component 104 is disposed within the cooling air passage 1022. In other words, the electrical component 104 is disposed between the upper surface 1025 of the inner housing 102 and the top wall of the accommodating chamber 1011, i.e. is disposed above the inner housing 102.

With the microwave oven 10 according to embodiments of the present invention, by disposing the electrical component 104 within the cooling air passage 1022 which is communicated with the second cooling air inlet 10211 and the air outlet of the cooling fan 103, all the cooling air sucked into the cooling air passage 1022 by the cooling fan 103 can be used to cool down the electrical component 104, thus greatly improving a cooling efficiency of the microwave oven 10. Moreover, after a heat exchange between the cooling air and the electrical component 104, a temperature of the cooling air is increased, then a temperature of the heating chamber 1021 cannot be reduced and a heating performance (e.g., cooking performance) of the microwave oven 10 cannot be influenced when the cooling air with increased temperature enters into the heating chamber 1021.

Thus, the microwave oven 10 according to embodiments of the present invention can have excellent cooling efficiency and heating performance.

As shown in FIG. 1-FIG. 8, in some embodiments, the outer housing 101 has a smoke inlet in a bottom thereof and a smoke outlet therein. A left air passage 1028 is formed between a left wall of the accommodating chamber 1011 and a left surface 1026 of the inner housing 102, and the left air passage 1028 is communicated with the smoke inlet and the smoke outlet of the outer housing 101. Correspondingly, a right air passage 1029 is formed between a right wall of the accommodating chamber 1011 and a right surface 1027 of the inner housing 102, and the right air passage 1029 is communicated with the smoke inlet and the smoke outlet of the outer housing 101. The microwave oven 10 may further include a left fan 1061 disposed within the left air passage 1028 and a right fan 1062 disposed within the right air passage 1029.

With the microwave oven 10 according to embodiments of the present invention, by forming the left and right air passages 1028, 1029 within the accommodating chamber 1011 and disposing the left and right fans 1061 and 1062 within the left and right air passages 1028, 1029 respectively, it is advantageous for the left and right fans 1061 and 1062 to suck oil smoke due to the positions of the left and right fans 1061 and 1062 adjacent to the smoke inlets, thus improving a oil smoke sucking performance of the microwave oven 10.

Thus, the microwave oven 10 according to embodiments of the present invention has a high capability of sucking the oil smoke.

Specifically, the microwave oven 10 according to embodiments of the present invention is configured as a ventilation-type microwave oven.

As shown in FIG. 1-FIG. 8, in some embodiments, the outer housing 101 may include a bottom plate 1014, a top plate 1015, a front plate 1016, a rear plate 1017, a left plate 1018 and a right plate 1019. The front plate 1016, the rear plate 1017, the left plate 1018 and the right plate 1019 are connected with the bottom and top plates 1014 and 1015, in other words, the front plate 1016, the rear plate 1017, the left plate 1018 and the right plate 1019 are disposed between the bottom and top plates 1014 and 1015.

The bottom plate 1014, the top plate 1015, front plate 1016, the rear plate 1017, the left plate 1018 and the right plate 1019 define the accommodating chamber 1011 therebetween. The smoke inlet may be formed in the bottom plate 1014, and the smoke outlet may be formed in at least one of the top plate 1015, the front plate 1016 and the rear plate 1017. The first cooling air inlet 10121 and outlet 10122 may be formed in the front plate 1016. Thus, the structure of the microwave oven 10 is reasonably configured.

An up-down direction is indicated as arrow A shown in FIG. 1-FIG. 3, FIG. 5 and FIG. 6, a left-right direction is indicated as arrow B shown in FIG. 1-FIG. 6, and a front-rear direction is indicated as arrow C shown in FIG. 1-FIG. 6.

Preferably, the smoke outlets may be formed in each of the top plate 1015, the front plate 1016 and the rear plate 1017. The oil smoke may be exhausted into a public flue via the smoke outlets formed in the top plate 1015 and/or the rear plate 1017.

The left air passage 1028 may be formed between the left plate 1018 and the left surface 1026 of the inner housing 102, the right air passage 1029 may be formed between the right plate 1019 and the right surface 1027 of the inner housing 102, in other words, the left air passage 1028 is defined by the front plate 1016, the rear plate 1017, the left plate 1018 and the left surface 1026 of the inner housing 102, and the right air passage 1029 is defined by the front plate 1016, the rear plate 1017, right plate 1019 and the right surface 1027 of the inner housing 102.

Figure 2:
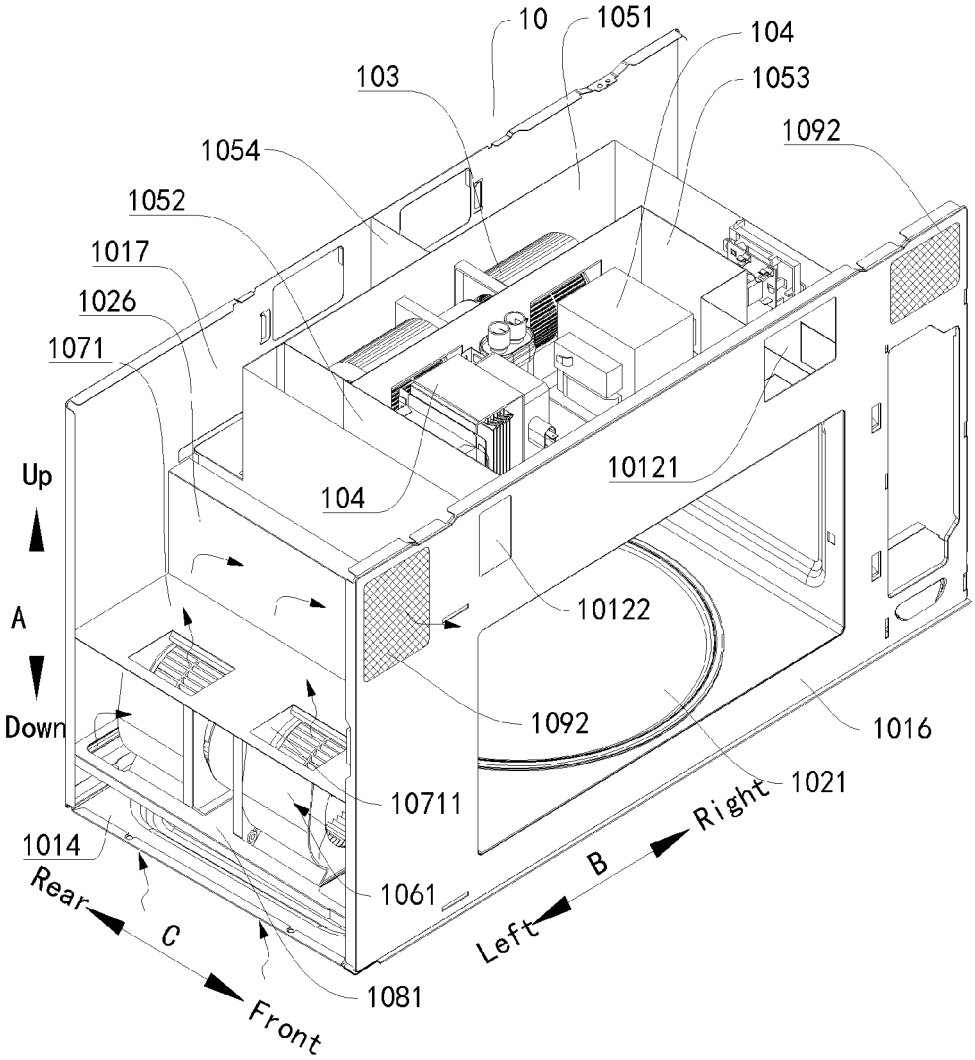
FIG. 2 is a perspective view of a microwave oven without an outer housing according to an embodiment of the present invention from one direction.
Figure 3:
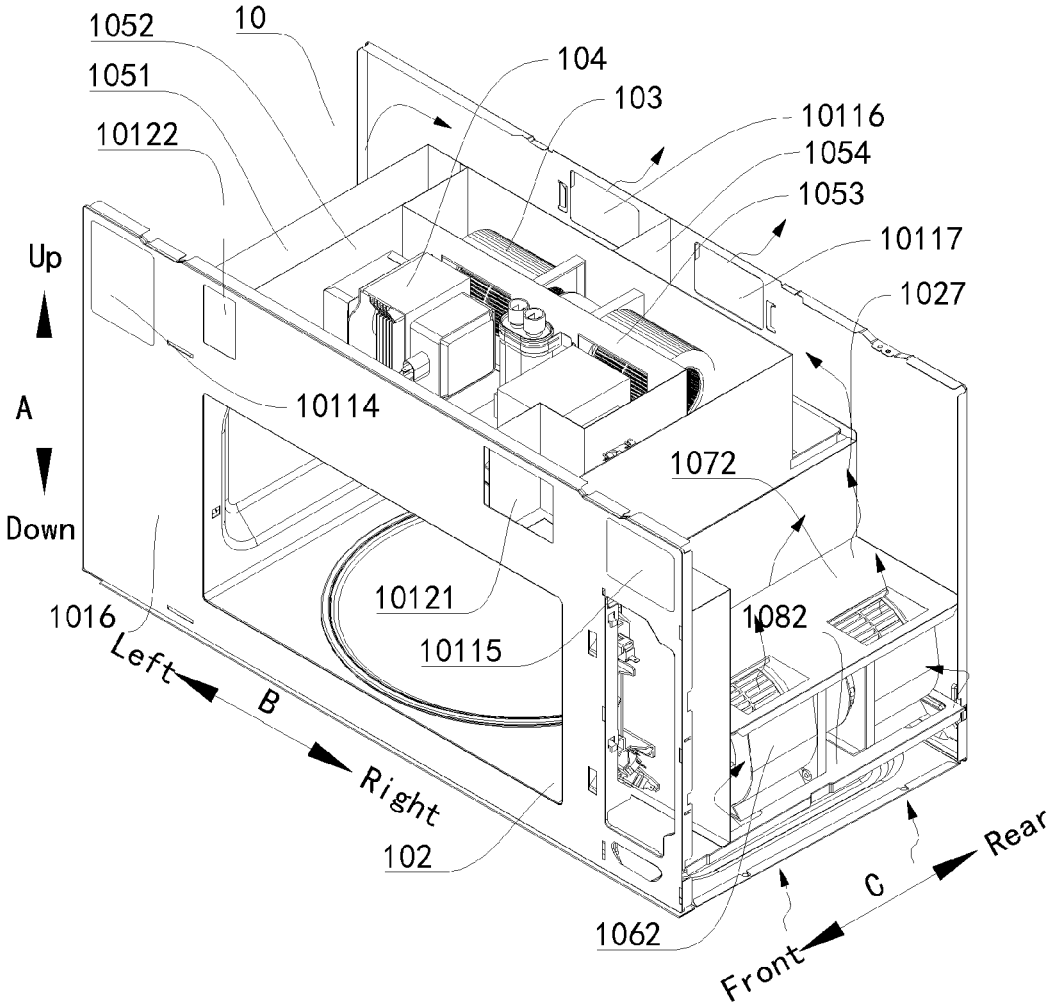
FIG. 3 is a perspective view of a microwave oven without an outer housing according to an embodiment of the present invention from another direction.
Figure 5:
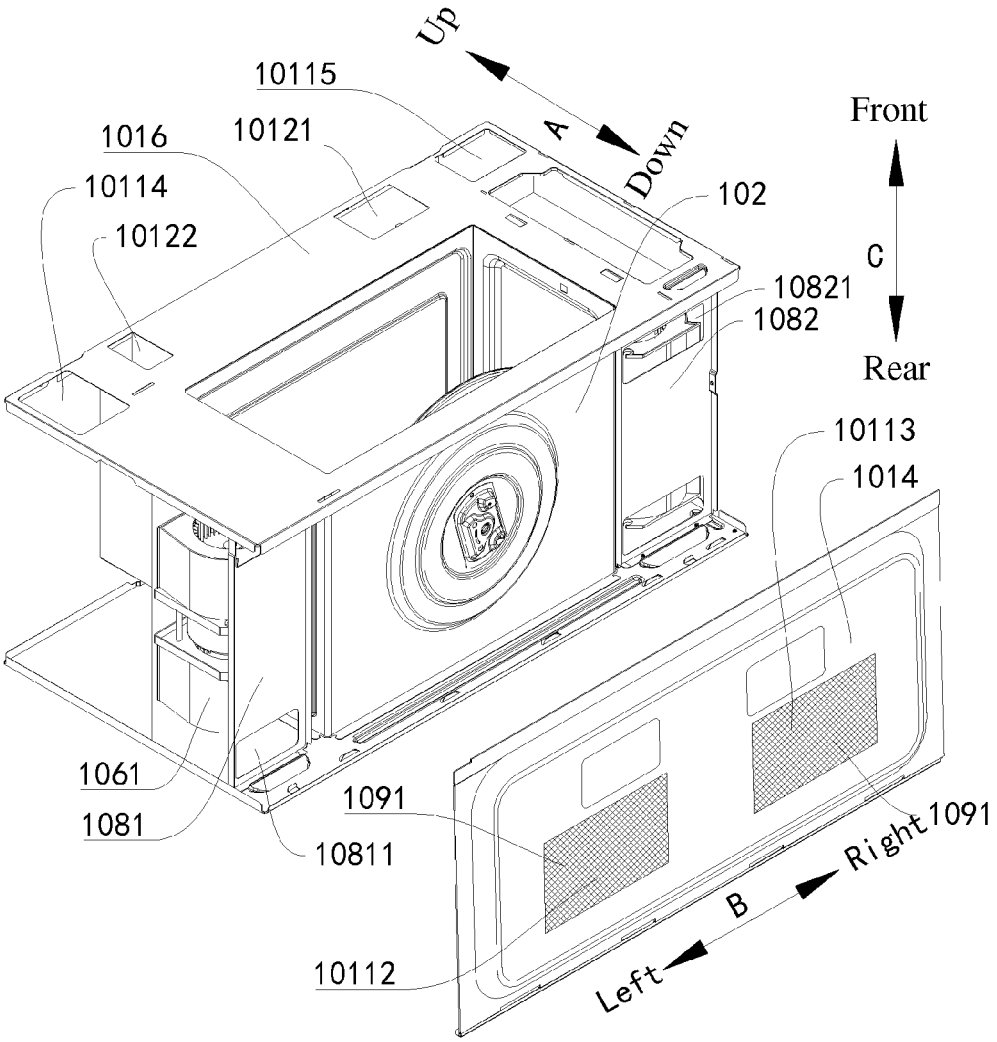
FIG. 5 is a partly exploded view of a microwave oven according to an embodiment of the present invention.

As shown in FIG. 2, FIG. 3 and FIG. 5, the microwave oven 10 may further include a first filter 1091 and a second filter 1092. The first filter 1091 is disposed on the bottom plate 1014 and covers the smoke inlet, and the second filter 1092 is disposed on the front plate 1016 and covers the smoke outlet. The smoke outlet may be formed in the front plate 1016, so that the oil smoke passing through the second filter 1092 may be exhausted into a room.

Figure 6:
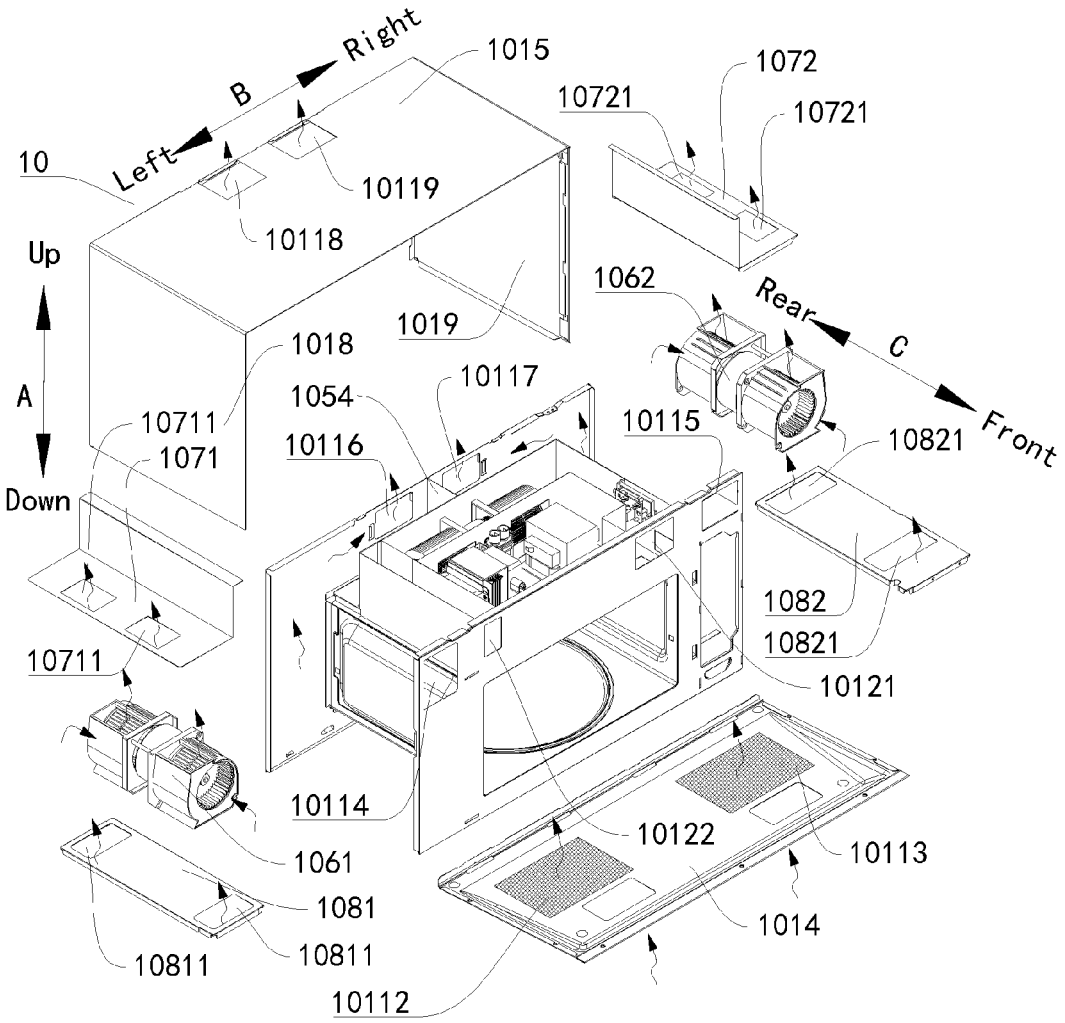
FIG. 6 is an exploded view of a microwave oven according to an embodiment of the present invention.

As shown in FIG. 6, in some embodiments, the smoke inlet of the outer housing 101 may include a left smoke inlet 10112 opposed to the left air passage 1028 in the up-down direction and a right smoke inlet 10113 opposed to the right air passage 1029 in the up-down direction. In other words, the left smoke inlet 10112 may be formed in a portion of the bottom plate 1014 which is aligned to the left air passage 1028, and the right smoke inlet 10113 may be formed in a portion of the bottom plate 1014 which is aligned to the right air passage 1029. Thus, the structure of the microwave oven 10 is reasonably configured.

As shown in FIG. 2 and FIG. 3, the smoke outlet of the outer housing 101 may include a first left smoke outlet 10114 communicated with the left air passage 1028 and a first right smoke outlet 10115 communicated with the right air passage 1029. The first left smoke outlet 10114 may be formed in an upper-left corner of the front plate 1016, and the first right smoke outlet 10114 may be formed in an upper-right corner of the front plate 1016.

Each of the left fan 1061 and the right fan 1062 may be disposed adjacent to the bottom plate 1014, in other words, the left fan 1061 may be adjacent to the left smoke inlet 10112, and the right fan 1062 may be adjacent to the right smoke inlet 10113. Thus, the smoke sucking capabilities of the left fan 1061 and the right fan 1062 can be improved.

In some embodiments, each of the left fan 1061 and the right fan 1062 may be configured as a double suction fan, so that the suction capability of the microwave oven 10 can be further improved, and a smoke exhaust efficiency of the microwave oven 10 can be further increased.

Each of the left fan 1061 and the right fan 1062 may be oriented horizontally, i.e. may be arranged horizontally, so that two air inlets of each of the left fan 1061 and the right fan 1062 may be used to suck the oil smoke. Thus, the smoke sucking capabilities of the left fan 1061 and the right fan 1062 can be improved.

As shown in FIG. 2-FIG. 6, each of the left fan 1061 and the right fan 1062 may be extended in the front-rear direction. Thus, a dimension of the microwave oven 10 in the left-right direction can be reduced, and the structure of the microwave oven 10 is reasonably configured.

In some embodiments, as shown in FIG. 2, FIG. 3, FIG. 5 and FIG. 6, the microwave oven 10 includes a left support plate 1081 and a right support plate 1082. The left support plate 1081 is disposed within the left air passage 1028 and the left fan 1061 may be mounted on the left support plate 1081. The right support plate 1082 is disposed within the right air passage 1029 and the right fan 1062 may be mounted on the right support plate 1082.

The left support plate 1081 may have a third vent 10881 therein which is corresponding to an air inlet of the left fan 1061, and the right support plate 1082 may have a fourth vent 10821 therein which is corresponding to an air inlet of the right fan 1062.

By disposing the left support plate 1081 and the right support plate 1082, the left fan 1061 and the right fan 1062 can be easily and stably assembled.

As shown in FIG. 6, two third vents 10811 may be provided, and the two third vents 10811 are formed in the left support plate 1081 and spaced apart from each other in the front-rear direction. The left fan 1061 may be configured as a double suction fan and is extended horizontally in the front-rear direction. Two air inlets of the left fan 1061 may be aligned to the two third vents 10811 respectively, such that the oil smoke may be sucked into the left fan 1061 via the two third vents 10811.

As shown in FIG. 6, two fourth vents 10821 may be provided, and the two fourth vents 10821 are formed in the right support plate 1082 and spaced apart from each other in the front-rear direction. The right fan 1062 may be configured as a double suction fan and is extended horizontally in the front-rear direction. Two air inlets of the right fan 1062 may be aligned to the two fourth vents 10821 respectively, such that the oil smoke may be sucked into the right fan 1062 via the two fourth vents 10821.

As shown in FIG. 2, FIG. 3 and FIG. 6, in some embodiments, the microwave oven 10 may further include a left air guard 1071 and a right air guard 1072. The left air guard 1071 may be disposed within the left air passage 1028 and located above the left fan 1061, and the left air guard 1071 has a first vent 10711 therein which is corresponding to an air outlet of the left fan 1061. The right air guard 1072 may be disposed within the right air passage 1029 and located above the right fan 1062, and the right air guard 1072 has a second vent 10721 therein which is corresponding to an air outlet of the right fan 1062.

By disposing the left air guard 1071 within the left air passage 1028 and positioning the left air guard 1071 above the left fan 1061, the oil smoke exhausted from the air outlets of the left fan 1061 can be prevented from re-sucking into the left fan 1061 via the air inlets of the left fan 1061.

Similarly, by disposing the right air guard 1072 within the right air passage 1029 and positioning the right air guard 1072 above the right fan 1062, the oil smoke exhausted from the air outlets of the right fan 1062 can be prevented from re-sucking into the right fan 1062 via the air inlets of the right fan 1062.

As shown in FIG. 6, two first vents 10711 may be provided, and the two first vents 10711 are formed in the left air guard 1071 and spaced apart from each other in the front-rear direction. The left fan 1061 may be configured as a double suction fan and is extended horizontally in the front-rear direction. Two air outlets of the left fan 1061 may be aligned to the two first vents 10711 respectively, such that the oil smoke may be exhausted via two first vents 10711.

As shown in FIG. 6, two second vents 10721 may be provided, and the two second vents 10721 are formed in the right air guard 1072 and spaced apart from each other in the front-rear direction. The right fan 1062 may be configured as a double suction fan and is extended horizontally in the front-rear direction. Two air outlets of the right fan 1062 may be aligned to the two second vents 10721 respectively, such that the oil smoke may be exhausted via two second vents 10721.

In some embodiments, a front edge of the left air guard 1071 may be contacted with the front plate 1016, a rear edge of the left air guard 1071 may be contacted with the rear plate 1017, a left edge of the left air guard 1071 may be contacted with the left plate 1018, and a right edge of the left air guard 1071 may be contacted with the left surface 1026 of the inner housing 102.

A front edge of the right air guard 1072 may be contacted with the front plate 1016, a rear edge of the right air guard 1072 may be contacted with the rear plate 1017, a left edge of the right air guard 1072 may be contacted with the right surface 1027 of the inner housing 102, and a right edge of the right air guard 1072 may be contacted with the right plate 1019.

As shown in FIG. 2-FIG. 4 and FIG. 6, the cooling fan 103 may be disposed within the air inlet passage 1023. Thus, the cooling fan 103 can suck more cooling air to cool down the electrical component 104, and the structure of the microwave oven 10 can be more compact.

As shown in FIG. 2-FIG. 4 and FIG. 6, the cooling fan 103 may be disposed between the upper surface 1025 of the inner housing 102 and the top wall of the accommodating chamber 1011. Thus, the dimension of the microwave oven 10 in the front-rear direction can be reduced.

Both of the electrical component 104 and the cooling fan 103 may be disposed on the upper surface 1025 of the inner housing 102, such that the electrical component 104 and the cooling fan 103 can be assembled stably. The cooling fan 103 may be configured as a double suction fan. Moreover, the cooling fan 103 may be oriented horizontally and extended in the left-right direction. The electrical components 103 may include, but is not limited to, a magnetron and a voltage transformer.

As shown in FIG. 2-FIG. 4 and FIG. 6, in some embodiments, the microwave oven 10 further includes a side plate 1051, a first plate 1052 and a second plate 1053. The side plate 1051 is disposed on the upper surface 1025 of the inner housing 102 and defines an accommodating space with a front wall of the accommodating chamber 1011. The first cooling air inlet 10121 and the first cooling air outlet 10122 are formed in the front wall of the accommodating chamber 1011.

The first plate 1052 may be disposed within the accommodating space, and the first plate 1052 defines an air outlet passage 1024 with the side plate 1051 and the front wall of the accommodating chamber 1011, and the first cooling air outlet 10122 and the second cooling air outlet 10212 may be communicated with each other via the air outlet passage 1024. The second plate 1053 may be disposed within the accommodating apace. The second plate 1053 defines one of the cooling air passage 1022 and the air inlet passage 1023 with the first plate 1052 and the front wall of the accommodating chamber 1011, and the second plate 1053 defines the other of the cooling air passage 1022 and the air inlet passage 1023 with the side plate 1051 and the front wall of the accommodating chamber 1011. Thus, the structure of the microwave oven 10 can be configured reasonably.

As shown in FIG. 2-FIG. 4 and FIG. 6, both of the first plate 1052 and the second plate 1053 may be disposed on the upper surface 1025 of the inner housing 102. The first cooling air inlet 10121 may be aligned to the air inlet passage 1023 in the front-rear direction, and the first cooling air outlet 10122 may be aligned to the air outlet passage 1024 in the front-rear direction. In some embodiments, the cooling air passage 1022 may be defined by the second plate 1053, the first plate 1052 and the front wall of the accommodating chamber 1011, and the air inlet passage 1023 may be defined by the second plate 1053, the side plate 1051 and the front wall of the accommodation chamber 1011.

Figure 4:
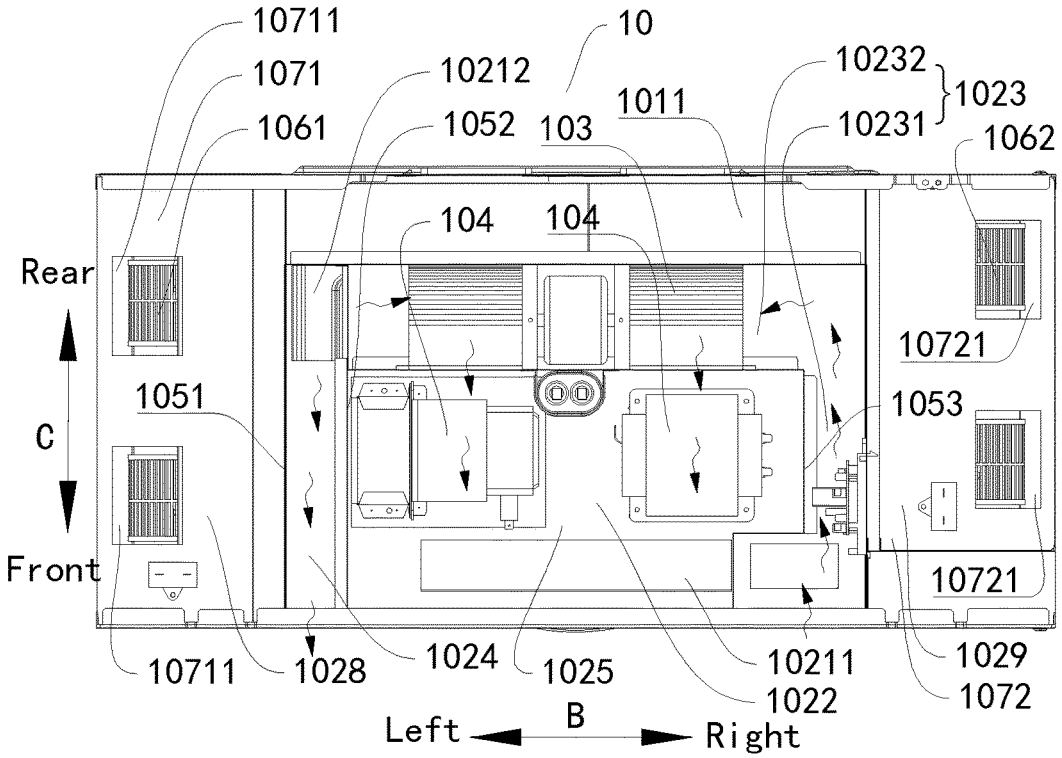
FIG. 4 is a top view of the microwave oven shown in FIG. 3.

As shown in FIG. 4, in some embodiments, the electrical component 104 may be disposed ahead of the cooling fan 103, the second cooling air inlet 10211 may be formed in the top wall of the heating chamber 1021 and is adapted to be adjacent to the front plate 1016, and the second cooling air outlet 10212 may be formed in the top wall of the heating chamber 1021 and is adapted to be adjacent to the rear plate 1017 and the left plate 1018.

In some embodiments, the electrical component 104 may be disposed behind the cooling fan 103, the second cooling air inlet 10211 may be formed in the top wall of the heating chamber 1021 and is adapted to be adjacent to the rear plate 1017, and the second cooling air outlet 10212 may be formed in the top wall of the heating chamber 1021 and is adapted to be adjacent to the front plate 1016 and the left plate 1018.

As shown in FIG. 4, the air inlet passage 1023 may include an air inlet section 10231 extended in the front-rear direction and a receiving section 10232 extended in the left-right direction. A front end of the air inlet section 10231 may be communicated with the first cooling air inlet 10121 and a rear end of the air inlet section 10231 may be communicated with a right end of the receiving section 10232. The cooling fan 103 may be disposed within the receiving section 10232 which is communicated with the cooling air passage 1022.

Figure 7:
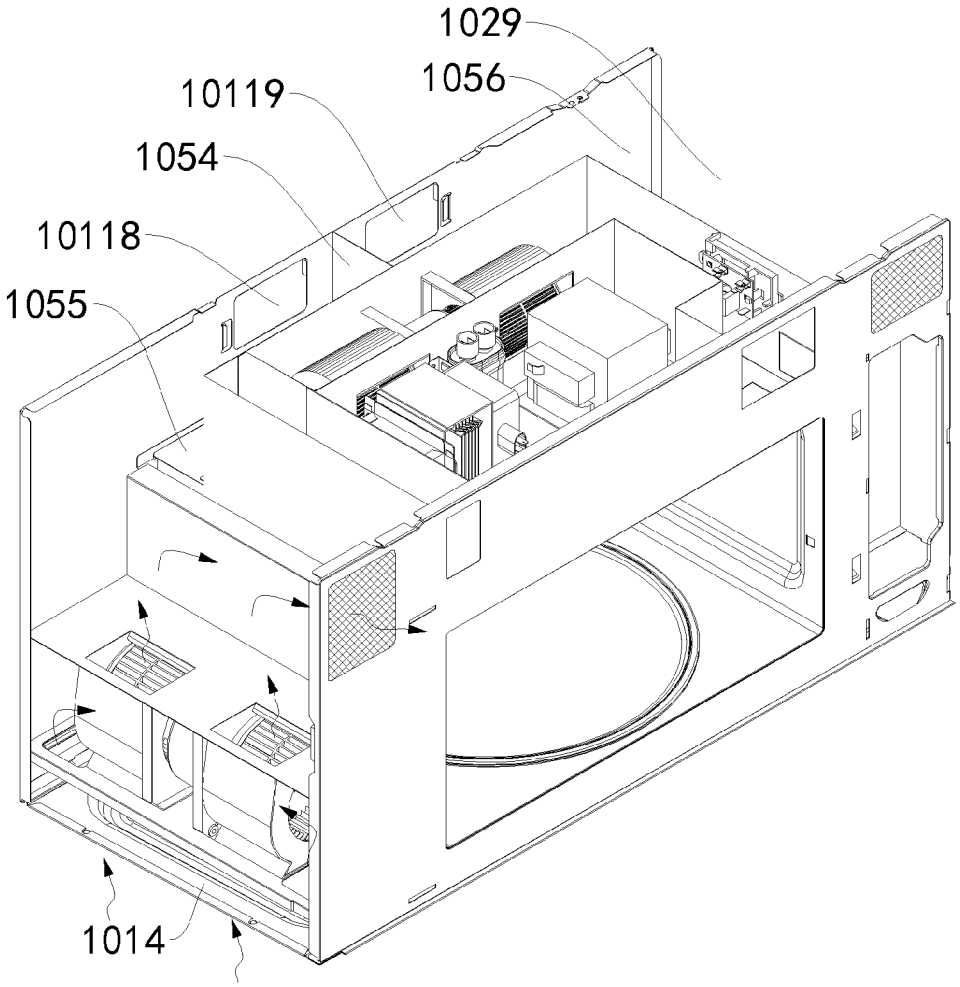
FIG. 7 is a partly perspective view of a microwave oven according to an embodiment of the present invention from one direction.
Figure 8:
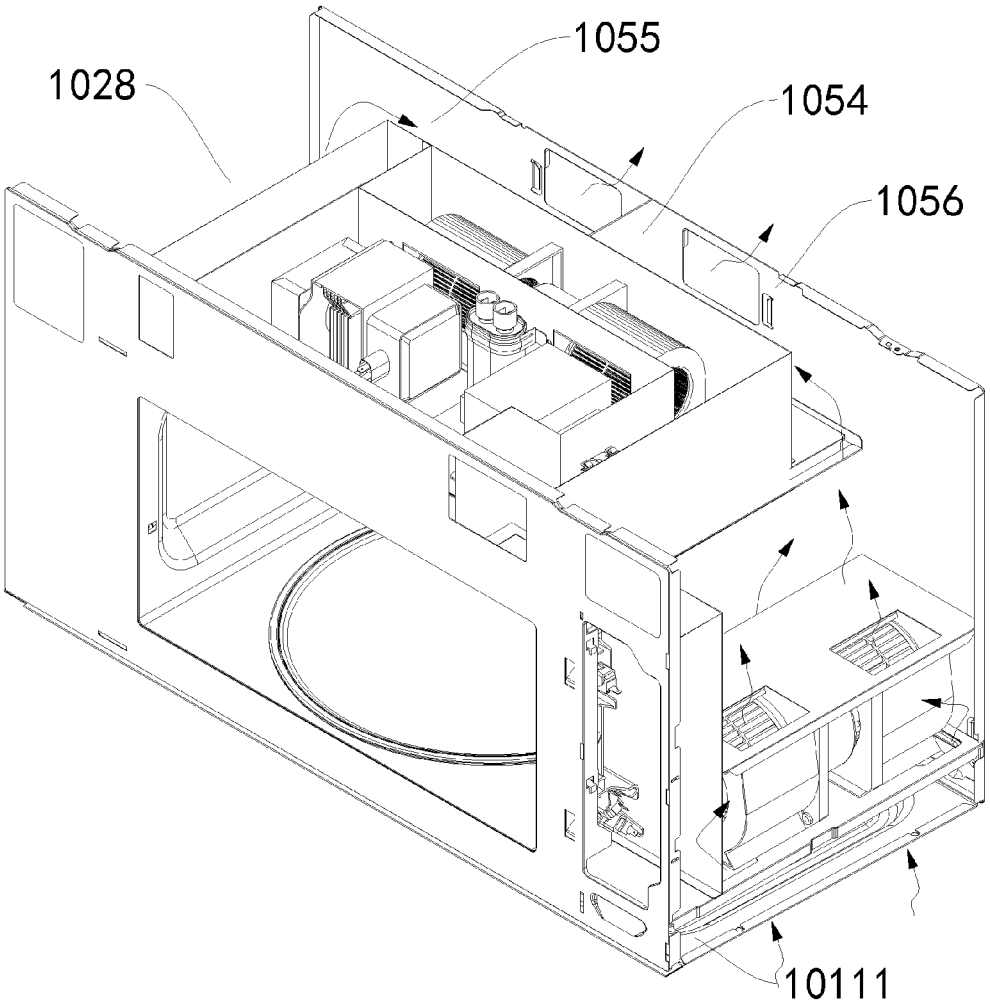
FIG. 8 is a partly perspective view of a microwave oven according to an embodiment of the present invention from another direction.

As shown in FIG. 7 and FIG. 8, in some embodiments, a left smoke inlet 10112 and a right smoke inlet 10113 are formed in a bottom wall 10111 of the accommodating chamber 1011. A left smoke outlet and a right smoke outlet are formed in at least one of a front wall, a top wall and a rear wall of the accommodating chamber 1011. The microwave oven 10 further includes a separating plate 1054. The separating plate 1054 is disposed within the accommodating chamber 1011 to divide the accommodating chamber 1011 into a left smoke exhaust passage 1055 and a right smoke exhaust passage 1056, and the left smoke exhaust passage 1055 and the right smoke exhaust passage 1056 are configured to be separated from each other. The left smoke inlet 10112 and the left smoke outlet are communicated with the left smoke exhaust passage 1055, and the right smoke inlet 10113 and the right smoke outlet are communicated with the right smoke exhaust passage 1056.

With the microwave oven 10 according to embodiments of the present invention, by dividing the accommodating chamber 1011 into the left and right smoke exhaust passages 1055, 1056 by the separating plate 1054, it is possible to prevent the air with oil smoke from the left and right smoke exhaust passages 1055, 1056 from being mixed, thus increasing a capability of exhausting the air with oil smoke.

As shown in FIGS. 6-8, in some embodiments, the front wall of the accommodating chamber 1011 has a first left smoke outlet 10114 and a first right smoke outlet 10115, the rear wall of the accommodating chamber 1011 has a second left smoke outlet 10116 and a second right smoke outlet 10117, and the top wall of the accommodating chamber 1011 has a third left smoke outlet 10118 and a third right smoke outlet 10119.

The first, second and third left smoke outlets 10114, 10116 and 10118 are communicated with the left smoke exhaust passage 1055, and the first, second and third right smoke outlets 10115, 10117 and 10119 are communicated with the right smoke exhaust passage 1056.

Specifically, the first left smoke outlet 10114 and the first right smoke outlet 10115 are formed in the front plate 1016, the second left smoke outlet 10116 and the second right smoke outlet 10117 are formed in the rear plate 1017, and the third left smoke outlet 10118 and the third right smoke outlet 10119 are formed in the top plate 1015.

The inner housing 102 is disposed within the accommodating chamber 1011 and defines the smoke exhaust passage with the walls of the accommodating chamber 1011.

As shown in FIG. 7 and FIG. 8, the separating plate 1054 is disposed within the smoke exhaust passage and divides the smoke exhaust passage into the left smoke exhaust passage 1055 and the right smoke exhaust passage 1056 separated from each other. The left smoke inlet 10112, the first left smoke outlet 10114, the second left smoke outlet 10116 and the third left smoke outlet 10118 are communicated with the left smoke exhaust passage 1055, and the right smoke inlet 10113, the first right smoke outlet 10115, the second right smoke outlet 10117 and the third right smoke outlet 10119 are communicated with the right smoke exhaust passage 1056.

Specifically, the microwave oven 10 may have three smoke exhausting manners, such like the front exhaustion, top exhaustion and rear exhaustion. When the front exhaustion is used, the first left smoke outlet 10114 and the first right smoke outlet 10115 are opened, and the second left smoke outlet 10116, the second right smoke outlet 10117, the third left smoke outlet 10118 and the third right smoke outlet 10119 are closed.

When the rear exhaustion is used, the second left smoke outlet 10116 and the second right smoke outlet 10117 are opened, and the first left smoke outlet 10114, the first right smoke outlet 10115, the third left smoke outlet 10118 and the third right smoke outlet 10119 are closed.

When the top exhaustion is used, the third left smoke outlet 10118 and the third right smoke outlet 10119 are opened, and the first left smoke outlet 10114 and the first right smoke outlet 10115, the second left smoke outlet 10116 and the second right smoke outlet 10117 are closed.

As shown in FIG. 7 and FIG. 8, the separating plate 1054 is disposed on the upper surface 1025 of the inner housing 102. A front edge of the separating plate 1054 is contacted with the side plate 1051, a rear edge of the separating plate 1054 is contacted with the rear wall of the accommodating chamber 1011, and an upper edge of the separating plate 1054 is contacted with the top wall of the accommodating chamber 101. Thus, the structure of the microwave oven 10 is reasonably configured.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A microwave oven, comprising:

an outer housing defining an accommodating chamber therein and having a first cooling air inlet and a first cooling air outlet therein;

an inner housing disposed within the accommodating chamber and defining a heating chamber therein, the heating chamber having a second cooling air inlet and a second cooling air outlet communicated with the first cooling air outlet, the second cooling air inlet and the second cooling air outlet being formed in the top wall of the heating chamber, a cooling air passage being defined between an upper surface of the inner housing and a top wall of the accommodating chamber and communicated with the second cooling air inlet;

a cooling fan having an air inlet communicated with the first cooling air inlet via an air inlet passage and an air outlet communicated with the cooling air passage, and the cooling fan being positioned between the upper surface of the inner housing and the top wall of the accommodating chamber; and an electrical component disposed within the cooling air passage, wherein the air inlet passage includes an air inlet section extended in a front-rear direction and a receiving section extended in a left-right direction, a front end of the air inlet section is communicated with the first cooling air inlet and a rear end of the air inlet section is communicated with a right end of the receiving section, and the cooling fan is disposed within the receiving section which is communicated with the cooling air passage, wherein the microwave oven further comprises:

a side plate disposed on the upper surface of the inner housing and defining an accommodating space with a front wall of the accommodating chamber, the first cooling air inlet and outlet being formed in the front wall of the accommodating chamber;

a first plate disposed within the accommodating space and defining an air outlet passage with the side plate and the front wall of the accommodating chamber, the first cooling air outlet and the second cooling air outlet being communicated with each other via the air outlet passage; and a second plate disposed within the accommodating space, the second plate defining one of the cooling air passage and the air inlet passage with the first plate and the front wall of the accommodating chamber, and the second plate defining the other of the cooling air passage and the air inlet passage with the side plate and the front wall of the accommodating chamber.

2. The microwave oven according to claim 1, wherein the cooling fan is disposed within the air inlet passage.

3. The microwave oven according to claim 1, further comprising a left fan and a right fan, wherein the outer housing defines a smoke inlet in a bottom thereof and a smoke outlet therein, wherein a left air passage is formed between a left wall of the accommodating chamber and a left surface of the inner housing and communicated with smoke inlet and the smoke outlet of the outer housing, the left fan is disposed within the left air passage, wherein a right air passage is formed between a right wall of the accommodating chamber and a right surface of the inner housing and communicated with smoke inlet and the smoke outlet of the outer housing, the right fan is disposed within the right air passage.

4. The microwave oven according to claim 3, wherein the smoke inlet comprises a left smoke inlet opposed to the left air passage in an up-down direction and a right smoke inlet opposed to the right air passage in the up-down direction.

5. The microwave oven according to claim 3, wherein each of the left fan and the right fan is configured as a double suction fan and oriented horizontally.

6. The microwave oven according to claim 5, wherein each of the left fan and the right fan is extended in a front-rear direction.

7. The microwave oven according to claim 3, further comprising:

a left air guard disposed within the left air passage and located above the left fan, the left air guard defining a first vent corresponding to an air outlet of the left fan; and a right air guard disposed within the right air passage and located above the right fan, the right air guard defining a second vent corresponding to an air outlet of the right fan.

8. The microwave oven according to claim 3, further comprising:

a left support plate disposed within the left air passage and defining a third vent corresponding to an air inlet of the left fan, the left fan being mounted on the left support plate; and a right support plate disposed within the right air passage and defining a fourth vent corresponding to an air inlet of the right fan, the right fan being mounted on the right support plate.

9. The microwave oven according to claim 3, wherein the outer housing comprises:

a bottom plate defining the smoke inlet therein;

a top plate;

a front plate connected with the bottom and top plates and defining the first cooling air inlet and outlet therein;

a rear plate connected with the bottom and top plates;

a left plate connected with the bottom and top plates; and a right plate connected with the bottom and top plates, wherein at least one of the top plate, the front plate and the rear plate defines the smoke outlet therein.

10. The microwave oven according to claim 9, wherein each of the left and right fans is adjacent to the bottom plate.

11. The microwave oven according to claim 9, further comprising a first filter and a second filter, wherein the front plate defines the smoke outlet therein, the first filter is disposed on the bottom plate and covers the smoke inlet, and the second filter is disposed on the front plate and covers the smoke outlet.

12. The microwave oven according to claim 3, further comprising a separating plate disposed within the accommodating chamber to divide the accommodating chamber into left and right smoke exhaust passages separated from each other, wherein a bottom wall of the accommodating chamber defines a left smoke inlet and a right smoke inlet spaced in a left-right direction, at least one of a front wall, the top wall and a rear wall of the accommodating chamber defines a left smoke outlet and a right smoke outlet spaced in the left-right direction, wherein the left smoke inlet and outlet are communicated with the left smoke exhaust passage, and the right smoke inlet and outlet are communicated with the right smoke exhaust passage.

13. The microwave oven according to claim 12, wherein the front wall of the accommodating chamber defines a first left smoke outlet and a first right smoke outlet, the rear wall of the accommodating chamber defines a second left smoke outlet and a second right smoke outlet, and the top wall of the accommodating chamber defines a third left smoke outlet and a third right smoke outlet, wherein the first, second and third left smoke outlets are communicated with the left smoke exhaust passage, and the first, second and third right smoke outlets are communicated with the right smoke exhaust passage.

14. The microwave oven according to claim 12, wherein the separating plate is disposed on the upper surface of the inner housing, a front edge of the separating plate is contacted with the side plate, a rear edge of the separating plate is contacted with the rear wall of the accommodating chamber, and an upper edge of the separating plate is contacted with the top wall of the accommodating chamber.

* * * * *